US009723958B1

(12) United States Patent
Walker

(10) Patent No.: US 9,723,958 B1
(45) Date of Patent: Aug. 8, 2017

(54) KENROY CLEANER SYSTEMS

(71) Applicant: Kenroy Walker, Sunrise, FL (US)

(72) Inventor: Kenroy Walker, Sunrise, FL (US)

( * ) Notice: Subject to any disclaimer, the term of this patent is extended or adjusted under 35 U.S.C. 154(b) by 596 days.

(21) Appl. No.: 14/197,081

(22) Filed: Mar. 4, 2014

Related U.S. Application Data

(60) Provisional application No. 61/881,099, filed on Sep. 23, 2013.

(51) Int. Cl.
*A47K 7/04* (2006.01)
*A47K 7/08* (2006.01)

(52) U.S. Cl.
CPC ..... *A47K 7/08* (2013.01); *A47K 7/043* (2013.01)

(58) Field of Classification Search
CPC ..... A47K 7/043; A47K 7/08
See application file for complete search history.

(56) References Cited

U.S. PATENT DOCUMENTS

| | | | | |
|---|---|---|---|---|
| 6,145,154 | A * | 11/2000 | Blair | A47K 7/028 15/143.1 |
| 6,272,716 | B1 | 8/2001 | Thornton | |
| 6,689,224 | B1 | 2/2004 | Hillman | |
| 7,249,392 | B1 | 7/2007 | Paille | |
| 8,875,337 | B2 * | 11/2014 | Tacoma | A47K 7/028 15/145 |
| 2004/0083567 | A1 * | 5/2004 | Lies | A47L 11/162 15/28 |
| 2012/0090115 | A1 * | 4/2012 | Parsons | A47K 7/08 15/143.1 |
| 2014/0060576 | A1 * | 3/2014 | Nelson | A47K 7/08 134/6 |

* cited by examiner

*Primary Examiner* — Randall Chin
(74) *Attorney, Agent, or Firm* — RG Patent Consulting, LLC; Rachel Gilroy

(57) ABSTRACT

Easy Clean is a tool specifically designed to help the elderly and disabled to clean themselves properly after a bowel movement. The device comprises a cone-shaped end with a handle; the handle being about nine inches in length for sufficient reach. The device also features a wipe dispensing unit encased within an aluminum handle that is about three inches in length. The dispenser may be fabricated from blue rubber. The device is used with flushable wipes.

15 Claims, 5 Drawing Sheets

KENROY CLEANER SYSTEMS

CROSS-REFERENCE TO RELATED APPLICATION

The present application is related to and claims priority from prior provisional application Ser. No. 61/881,099, filed Sep. 23, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of body cleaning devices and more specifically relates to a personal cleaning system.

2. Description of the Related Art

Individuals often have to relieve themselves many times a day. Sometimes this may be an uncomfortable task, especially for the elderly. Elderly persons may have difficulty reaching the anus and the general area such that they are properly cleaned when defecation has been completed. Toilet paper, in of itself, may not provide the adequate cleaning necessary to avoid problems associated with the lack of cleanliness. Problems may include unpleasant odors, sores and the like. These problems may develop into more serious health related issues if the body is left not properly cleaned for a long duration. It is desirable that a solution be provided that is comfortable and easy to use, yet provides a thorough means for consistently maintaining personal hygiene.

Various attempts have been made to solve the above-mentioned problems such as those found in U.S. Pat. No. 6,272,716 to Kent J. Thornton, U.S. Pat. No. 7,249,392 to Michel G. Paille; and U.S. Pat. No. 6,689,224 to Rosemary Hillman. This art is representative of personal hygiene tools. None of the above inventions and patents, taken either singly or in combination, is seen to describe the invention as claimed.

Ideally, a personal cleaning system should provide an effective and efficient means for maintaining personal hygiene and, yet would operate reliably and be manufactured at a modest expense. Thus, a need exists for a reliable personal cleaning system to avoid the above-mentioned problems.

BRIEF SUMMARY OF THE INVENTION

In view of the foregoing disadvantages inherent in the known hygiene tool art, the present invention provides a novel personal cleaning system. The general purpose of the present invention, which will be described subsequently in greater detail is to provide an efficient body cleaning means.

A personal cleaning system is disclosed herein comprising: a personal hygiene tool assembly having a wipe engaging end, a wipe-engaging and disengaging assembly (having a control button, a linkage, and biaser), a handle (having a proximate end, and a distal end), a grip, and a strap. The personal cleaning system comprises the personal hygiene tool assembly. The personal hygiene tool assembly comprises in functional combination the wipe engaging end, the wipe-engaging and disengaging assembly, the handle, the grip, and the strap. The wipe-engaging and disengaging assembly comprises in mechanical communication the control button, the linkage, and the biaser.

The wipe engaging end is located on the distal end of the handle; the wipe engaging end is generally conically-shaped. The wipe engaging end comprises an interior volume wherein the pre-moistened wipe is held by the biaser, a portion of the pre-moistened wipe remaining outside of the wipe engaging end to contact-clean the rectal vicinity. The wipe engaging end comprises rubber such that the wipe engaging end is non-abrasive to the rectal vicinity of the user when used. The wipe engaging end is reasonably flexible and is about three inches deep. The grip and the strap are located at the proximate end of the handle; wherein the handle comprises aluminum such that the personal hygiene tool assembly is lightweight during use and is about nine inches in length allowing sufficient reach for a user to be able to contact a rectal vicinity with relative ease.

The linkage and the biaser of the wipe-engaging and disengaging assembly is effectively contained within confines of the handle and the wipe engaging end; the linkage and the biaser controlled by manipulation of the control button, the control button accessible and located at the handle and through the grip. The user is able to manipulate the control button which controls the linkage to control the biaser for engaging and alternately disengaging a pre-moistened wipe for use and after the use, respectively.

An outer surface of the wipe engaging end is able to be covered via a disposable sleeve for use with multiple persons when desired for example in hospital or health-care facilities. The pre-moistened wipe(s) used is flushable and biodegradable. The pre-moistened wipe when engaged for use by the biaser forms a conical profile (due to the general contour and flared design of the biaser) to maximize surface contact area against the rectal vicinity to prevent bunching of the pre-moistened wipe.

The grip preferably comprises foam for promoting comfort during the use and is about four inches long. The strap preferably comprises nylon, wherein the strap comprises a loop such that the personal hygiene tool assembly is able to be stored in a hanging condition (and wrapped around the user's palm or forearm during use to prevent dropping the device out of reach). The grip and the strap in combination are used to securely hold and manipulate the personal hygiene tool assembly as the user remotely cleans the rectal vicinity after a bowel movement using the pre-moistened wipe to maintain personal hygiene.

A kit including: the personal hygiene tool assembly, a plurality of the pre-moistened wipe(s), a plurality of the disposable sleeve(s), and a set of user-instructions is also described herein. The kit may also include a mountable shelf for storage.

A method of using a personal cleaning system is also disclosed herein comprising the steps of: engaging a pre-moistened wipe using a personal hygiene tool assembly via a biaser controlled via a linkage and a control button operated by a user, wiping a rectal vicinity with the pre-moistened wipe to provide cleaning of the rectal vicinity, and disposing of the pre-moistened wipe after use. The method may further comprise the step of donning a disposable sleeve on a wipe engaging end before the engaging step to increase cleanliness for multiple uses. It should be appreciated that sanitizing using acceptable means (such as using fluids or the like) may be employed during its use.

The present invention holds significant improvements and serves as a personal cleaning system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, personal cleaning system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a hygiene tool and more particularly to a personal cleaning system as used to improve the personal hygiene of users.

Generally speaking, the present invention (entitled Easy Clean) is a tool specifically designed to help the elderly and disabled to clean themselves properly after a bowel movement. The device comprises a cone-shaped end with a handle; the handle being about nine inches in length for sufficient reach. The device also features a wipe dispensing unit encased within an aluminum handle that is about three inches in length. The dispenser may be fabricated from blue rubber. The device is for use with disposable wipes. A button allows the user to easily pick up and release wipes as necessary for cleaning. A strap is also provided on preferred embodiments to promote a secure grip of the device and for hanging as needed between uses.

Figure 1:
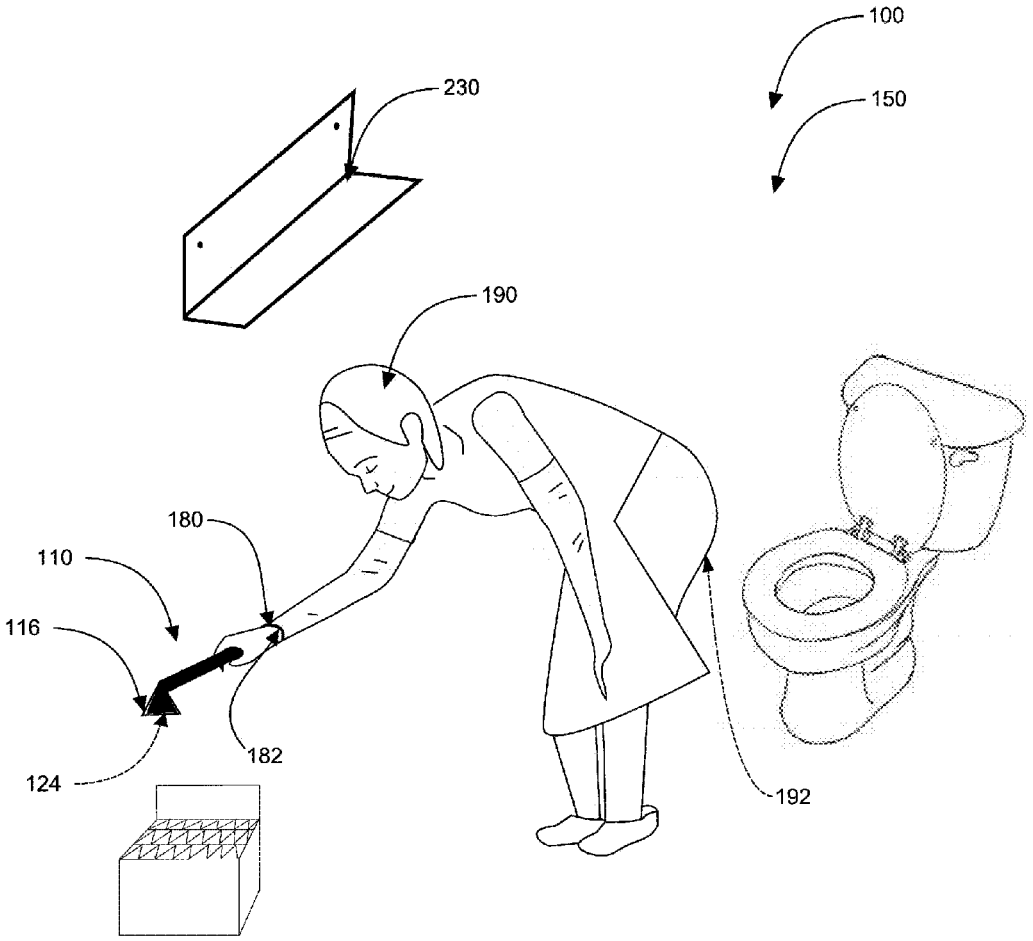
FIG. 1 shows a perspective view illustrating a personal hygiene tool assembly of a personal cleaning system in an in-use condition according to an embodiment of the present invention.

Referring to the drawings by numerals of reference there is shown in FIG. 1, a perspective view illustrating personal hygiene tool assembly 110 of personal cleaning system 100 in an in-use condition 150 according to an embodiment of the present invention.

Personal cleaning system 100 comprises: personal hygiene tool assembly 110 having wipe engaging end 120, wipe-engaging and disengaging assembly 130 having control button 132, linkage 134 (suitable equivalent linking means may be used), and biaser 136, handle 160 having proximate end 162, and distal end 164, grip 170, and strap 180. As such personal cleaning system 100 comprises personal hygiene tool assembly 110; wherein personal hygiene tool assembly 110 comprises in functional combination wipe engaging end 120, wipe-engaging and disengaging assembly 130, handle 160, grip 170, and strap 180.

Figure 2:
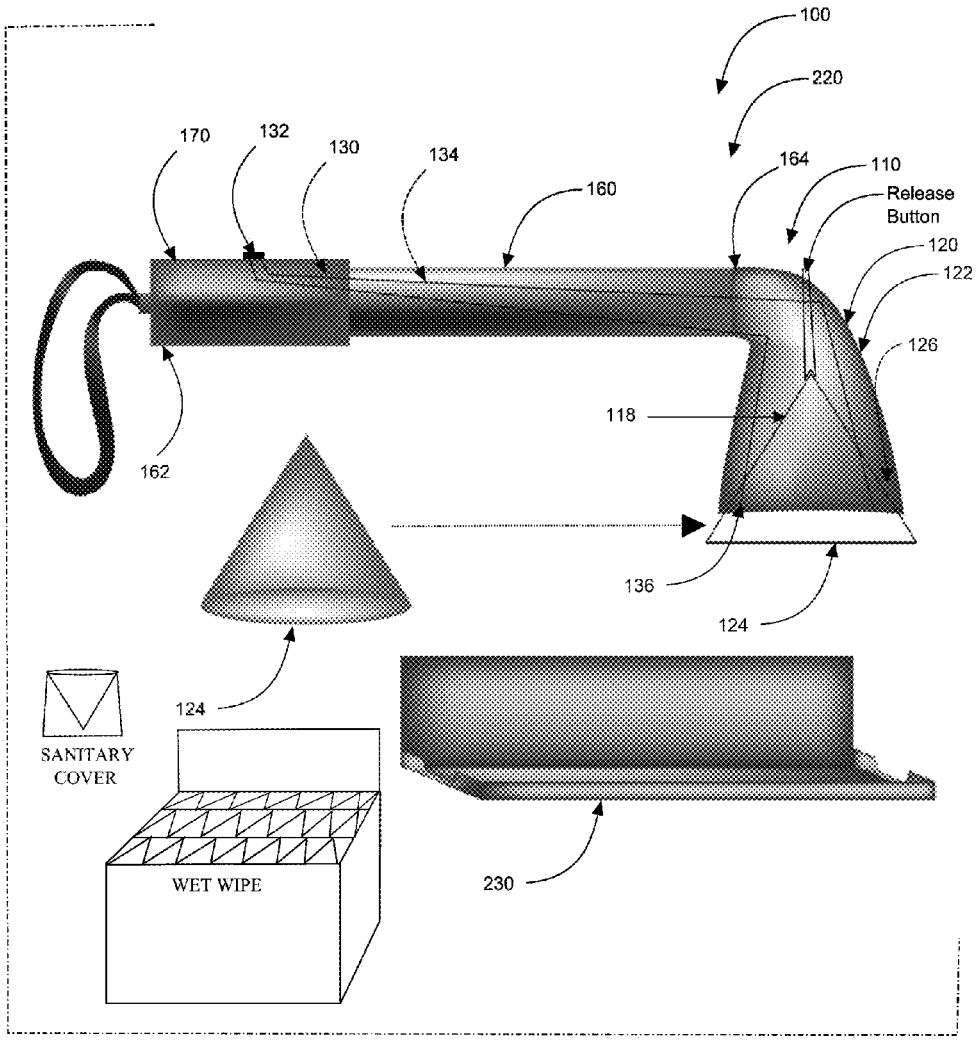
FIG. 2 is a perspective view illustrating a kit including the personal hygiene tool assembly, a pre-moistened wipe and a mountable shelf according to an embodiment of the present invention of FIG. 1.
Figure 3:
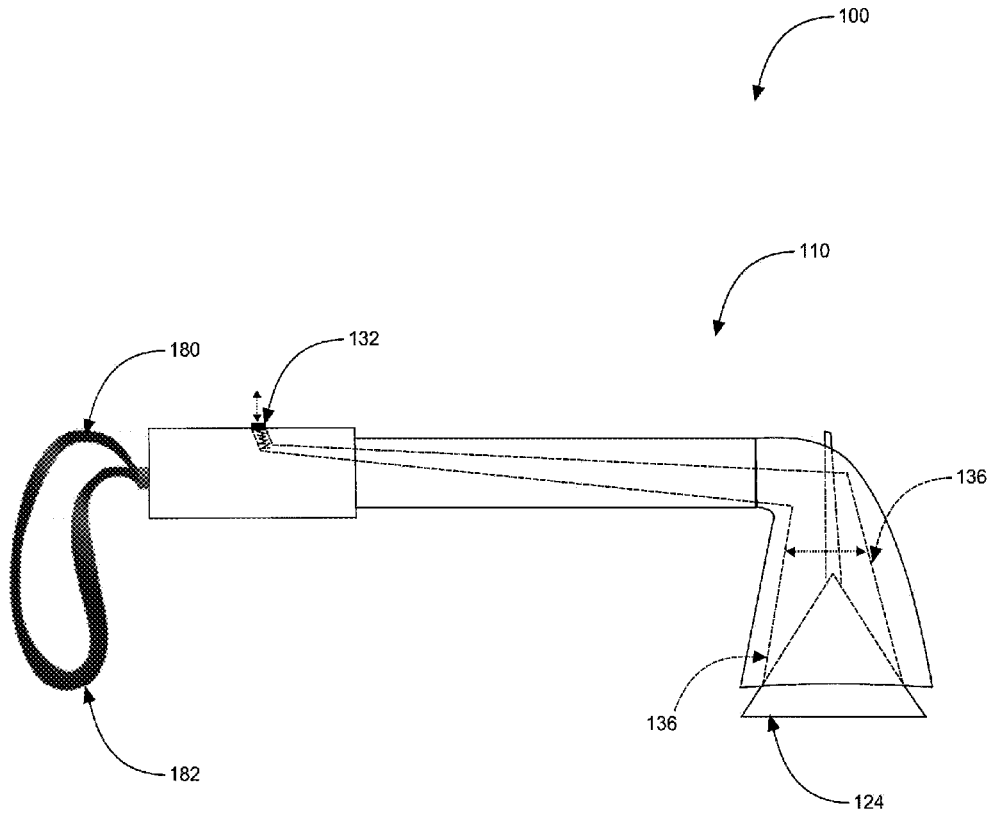
FIG. 3 is a perspective view illustrating the personal hygiene tool assembly showing a wipe engaging end, a wipe-engaging and disengaging assembly (in dashed lines), a handle, a grip, and a strap according to an embodiment of the present invention of FIG. 1.

Wipe-engaging and disengaging assembly 130 comprises in mechanical communication control button 132 (or other suitable equivalent switch or the like), linkage 134, and biaser 136. Wipe engaging end 120 is located on distal end 164 of handle 160, as also shown in FIGS. 2 & 3. Grip 170 and strap 180 are located at proximate end 162 of handle 160.

Linkage 134 and biaser 136 of wipe-engaging and disengaging assembly 130 is contained within confines of handle 160 and wipe engaging end 120; linkage 134 and biaser 136 controlled by manipulation of control button 132; control button 132 accessible and located at handle 160 and through grip 170. User 190 is able to manipulate control button 132 which controls linkage 134 to control biaser 136 for engaging and alternately disengaging at least one pre-moistened wipe 124 for use and after the use, respectively. Biaser 136 is biased to grasp pre-moistened wipe 124 using tensioning means. When not biased biaser 136 is allowed to drop pre-moistened wipe 124 into the toilet or waste basket. Those with ordinary skill in the art will now appreciate that upon reading this specification and by their understanding the art of biasing as described herein, methods of grasping and releasing of objects will be understood by those knowledgeable in such art.

Grip 170 and strap 180 in combination are used to securely hold and manipulate personal hygiene tool assembly 110 as user 190 remotely cleans rectal vicinity 192 after a bowel movement using pre-moistened wipe 124 to maintain personal hygiene. In health-care facility applications outer surface 122 of wipe engaging end 120 is able to be covered via disposable sleeve 116 for use with multiple persons. Suitable sanitizing is employed as required to maintain public health.

Referring now to FIG. 2, a perspective view illustrating kit 220 including personal hygiene tool assembly 110, pre-moistened wipe 124, and mountable shelf 230 are shown according to an embodiment of the present invention of FIG. 1.

Figure 4:
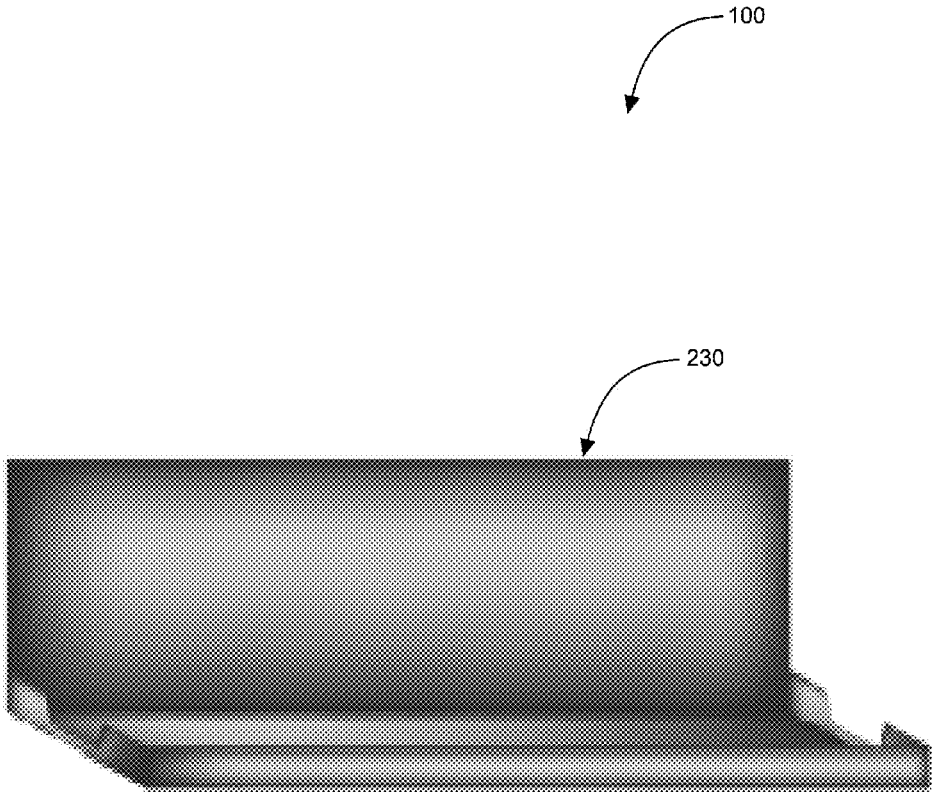
FIG. 4 is a perspective view illustrating the mountable shelf according to an embodiment of the present invention of FIGS. 1 and 2.

Personal cleaning system 100 may be sold as kit 220 comprising the following parts: at least one personal hygiene tool assembly 110; a plurality of pre-moistened wipe(s) 124, a plurality of disposable sleeve(s) 116, and a set of user-instructions. The kit may also include a mountable shelf 230 for storage thereon (as also shown in FIG. 4). The kit 220 has instructions such that functional relationships are detailed in relation to the structure of the invention (such that the invention can be used, maintained, or the like in a preferred manner). Personal cleaning system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Referring now to FIG. 3, a perspective view illustrating personal hygiene tool assembly 110 according to an embodiment of the present invention of FIG. 1 is shown.

Wipe engaging end 120 is generally conically-shaped, as shown. Wipe engaging end 120 comprises interior volume 126 wherein pre-moistened wipe 124 is held by biaser 136, a portion of pre-moistened wipe 124 remaining outside of wipe engaging end 120 to contact-clean rectal vicinity 192. Wipe engaging end 120 comprises rubber such that wipe engaging end 120 is non-abrasive to rectal vicinity 192 of user 190 when used. Wipe engaging end 120 is about three inches deep in preferred embodiments for ease of use. Wipe engaging end 120 is preferably flexible.

Referring now to handle 160 preferably comprises aluminum (or other suitably equivalent material) such that personal hygiene tool assembly 110 is relatively lightweight for ease of use by handi-capped or elderly users 190. Handle 160 is preferably about nine inches in length allowing sufficient reach for user 190 to be able to contact rectal vicinity 192 with relative ease. Referring now to grip 170; grip 170 preferably comprises foam. Grip 170 is about four inches long. Strap 180 comprises loop 182 such that personal hygiene tool assembly 110 is able to be stored in a hanging condition. Personal hygiene tool assembly 110 may alternately be stored on mountable shelf 230. Strap 180 preferably comprises nylon; however other materials may be used. FIG. 4, shows a perspective view illustrating mountable shelf 230 according to an embodiment of the present invention of FIGS. 1 and 2.

Figure 5:
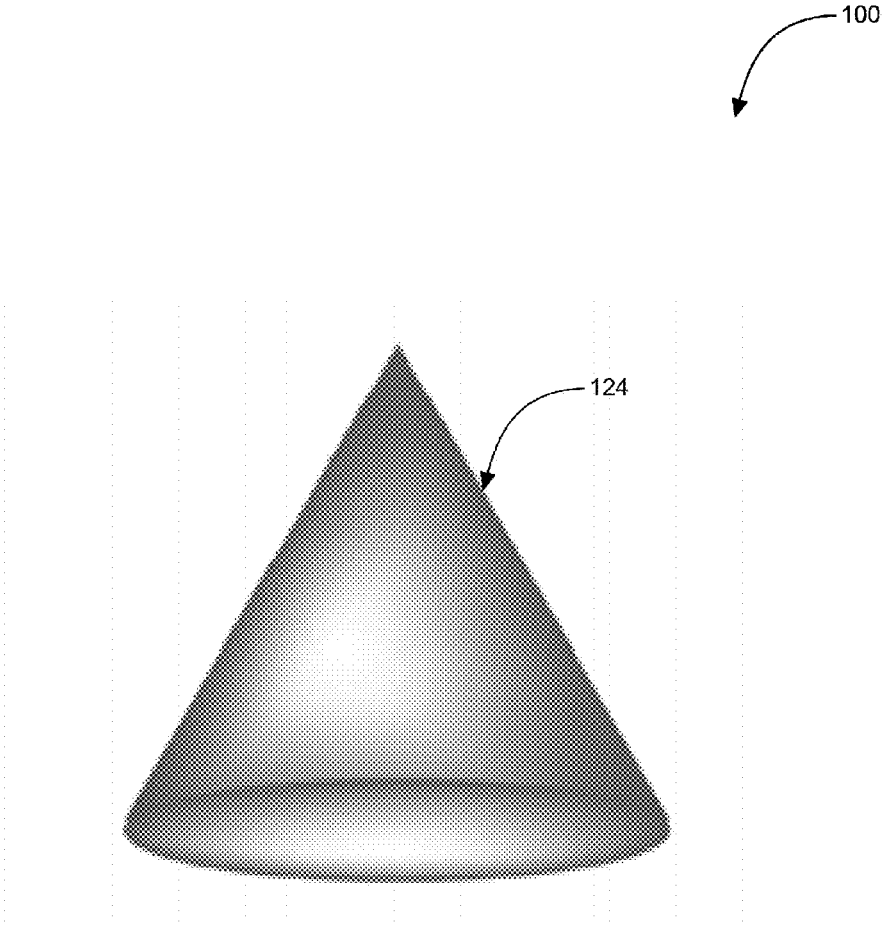
FIG. 5 is a perspective view of a pre-moistened wipe (general profile as ready for use) of the personal cleaning system according to an embodiment of the present invention of FIGS. 1-4.

Referring now to FIG. 5, a perspective view of pre-moistened wipe 124 (general profile as ready for use) of personal cleaning system 100 according to an embodiment of the present invention of FIGS. 1-4.

Pre-moistened wipe 124 once used is flushable; pre-moistened wipe 124 is biodegradable. Pre-moistened wipe 124 when engaged for use by biaser 136 forms a conical profile 118 to maximize surface contact area against rectal vicinity 192 to prevent bunching of pre-moistened wipe 124.

A method of using a personal cleaning system 100 may comprise the steps of: engaging pre-moistened wipe 124 using personal hygiene tool assembly 110 via biaser 136 controlled via linkage 134 and control button 132 operated by user 190, wiping rectal vicinity 192 with pre-moistened wipe 124 to provide cleaning of rectal vicinity 192, and disposing of pre-moistened wipe 124 after use. The method may further comprise the step of donning disposable sleeve 116 on wipe engaging end 120 before the engaging step to increase cleanliness for multiple uses. It should be appreciated that sanitizing using acceptable means (such as using fluids or the like) may be employed during its use.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A personal cleaning system comprising:

a personal hygiene tool assembly having;
- a wipe engaging end;
- a wipe-engaging and disengaging assembly having;
  - a control button; and
  - a linkage; and
  - biaser;
- a handle having;
  - a proximate end; and
  - a distal end;
- a grip; and
- a strap;

wherein said personal hygiene tool assembly comprises in functional combination said wipe engaging end, said wipe-engaging and disengaging assembly, said handle, said grip, and said strap;

wherein said wipe-engaging and disengaging assembly comprises in mechanical communication said control button, said linkage, and said biaser;

wherein said wipe engaging end is located on said distal end of said handle;

wherein said grip and said strap are located at said proximate end of said handle;

wherein said linkage and said biaser of said wipe-engaging and disengaging assembly is contained within confines of said handle and said wipe engaging end, said linkage and said biaser controlled by manipulation of said control button, said control button accessible and located at said handle and through said grip;

wherein a user is able to manipulate said control button which controls said linkage to control said biaser for engaging and alternately disengaging a pre-moistened wipe for use and after said use, respectively; and wherein said grip and said strap in combination are used to securely hold and manipulate said personal hygiene tool assembly as said user remotely cleans a rectal vicinity after a bowel movement using said pre-moistened wipe to maintain personal hygiene;

wherein said wipe engaging end is generally conically-shaped;

wherein said wipe engaging end comprises an interior volume wherein said pre-moistened wipe is held by said biaser, a portion of said pre-moistened wipe remaining outside of said wipe engaging end to contact-clean said rectal vicinity; and wherein said wipe engaging end comprises rubber such that said wipe engaging end is non-abrasive to said rectal vicinity of said user when used.

2. The personal cleaning system of claim 1 wherein said handle comprises aluminum such that said personal hygiene tool assembly is lightweight.

3. The personal cleaning system of claim 2 wherein said handle is about nine inches in length allowing sufficient reach for said user to be able to contact said rectal vicinity with relative ease.

4. The personal cleaning system of claim 1 wherein said pre-moistened wipe used is flushable.

5. The personal cleaning system of claim 4 wherein said pre-moistened wipe used is biodegradable.

6. The personal cleaning system of claim 5 wherein said pre-moistened wipe when engaged for use by said biaser forms a conical profile to maximize surface contact area against said rectal vicinity to prevent bunching of said pre-moistened wipe.

7. The personal cleaning system of claim 1 wherein an outer surface of said wipe engaging end is able to be covered via a disposable sleeve for use with multiple persons.

8. The personal cleaning system of claim 1 wherein said grip comprises foam.

9. The personal cleaning system of claim 8 wherein said grip is about four inches long.

10. The personal cleaning system of claim 1 wherein said strap comprises a loop such that said personal hygiene tool assembly is able to be stored in a hanging condition.

11. The personal cleaning system of claim 10 wherein said strap comprises nylon.

12. The personal cleaning system of claim 1 wherein said wipe engaging end is about three inches deep.

13. The personal cleaning system of claim 12 wherein said wipe engaging end is flexible.

14. A personal cleaning system comprising:

a personal hygiene tool assembly having;

a wipe engaging end;

a wipe-engaging and disengaging assembly having;

a control button; and a linkage; and biaser;

a handle having;

a proximate end; and a distal end;

a grip; and a strap;

wherein said personal hygiene tool assembly comprises in functional combination said wipe engaging end, said wipe-engaging and disengaging assembly, said handle, said grip, and said strap;

wherein said wipe-engaging and disengaging assembly comprises in mechanical communication said control button, said linkage, and said biaser;

wherein said wipe engaging end is located on said distal end of said handle;

wherein said wipe engaging end is generally conically-shaped;

wherein said wipe engaging end comprises an interior volume wherein a pre-moistened wipe can be held by said biaser, wherein a portion of said pre-moistened wipe can remain outside of said wipe engaging end to contact-clean said rectal vicinity;

wherein said wipe engaging end comprises rubber such that said wipe engaging end is non-abrasive to said rectal vicinity of said user when used;

wherein said wipe engaging end is flexible;

wherein said wipe engaging end is about three inches deep;

wherein said grip and said strap are located at said proximate end of said handle;

wherein said handle comprises aluminum such that said personal hygiene tool assembly is lightweight during use;

wherein said handle is about nine inches in length allowing sufficient reach for a user to be able to contact a rectal vicinity with relative ease;

wherein said linkage and said biaser of said wipe-engaging and disengaging assembly is contained within confines of said handle and said wipe engaging end, said linkage and said biaser controlled by manipulation of said control button, said control button accessible and located at said handle and through said grip;

wherein said user is able to manipulate said control button which controls said linkage to control said biaser for engaging and alternately disengaging a pre-moistened wipe for use and after said use, respectively;

wherein an outer surface of said wipe engaging end is able to be covered via a disposable sleeve for use with multiple persons;

wherein said pre-moistened wipe used is flushable;

wherein said pre-moistened wipe used is biodegradable;

wherein said pre-moistened wipe when engaged for use by said biaser forms a conical profile to maximize surface contact area against said rectal vicinity to prevent bunching of said pre-moistened wipe;

wherein said grip comprises foam for promoting comfort during said use;

wherein said grip is about four inches long;

wherein said strap comprises nylon;

wherein said strap comprises a loop such that said personal hygiene tool assembly is able to be stored in a hanging condition; and wherein said grip and said strap in combination are used to securely hold and manipulate said personal hygiene tool assembly as said user remotely cleans said rectal vicinity after a bowel movement using said pre-moistened wipe to maintain personal hygiene.

15. The personal cleaning system of claim 14 further comprising a kit including:

said personal hygiene tool assembly;

a plurality of said pre-moistened wipe(s);

a plurality of said disposable sleeve(s); and a set of user-instructions.

* * * * *